United States Patent [19]

Allemann

[11] 4,183,565

[45] Jan. 15, 1980

[54] LATCH BOLT LOCKING MECHANISM FOR FIRE DOOR LOCKSETS

[75] Inventor: James G. Allemann, South Gate, Calif.

[73] Assignee: Norris Industries, Inc., South Gate, Calif.

[21] Appl. No.: 937,504

[22] Filed: Aug. 28, 1978

[51] Int. Cl.[2] ..... E05C 1/00; E05C 13/02

[52] U.S. Cl. ..... 292/163; 292/150; 292/DIG. 66

[58] Field of Search ..... 292/150, 163, DIG. 66; 49/8

[56] References Cited

U.S. PATENT DOCUMENTS

| | | | |
|---|---|---|---|
| 1,520,509 | 12/1924 | Rancour | 292/150 X |
| 1,541,093 | 6/1925 | Amico | 292/150 |
| 1,617,813 | 2/1927 | Judge | 292/163 X |
| 3,026,703 | 3/1962 | Welch | 292/150 X |
| 3,705,739 | 12/1972 | Adler | 292/DIG. 66 |
| 4,012,066 | 3/1977 | Salvatore | 292/DIG. 66 |

*Primary Examiner*—Richard E. Moore

[57] ABSTRACT

To lock the head of a latchbolt in extended, or locked position therein to prevent opening of a door in case of fire the latch bolt head is provided with a spring driven locking pin reciprocatably mounted in a transverse direction. In the extended locked position of the latch bolt head the locking pin is in alignment with but withdrawn clear of a hole in the latch bolt case. At the inside end of the locking pin is a groove and a fusible pin normally engages the groove holding the locking pin in withdrawn position. This permits normal latch bolt action. When the fusible pin melts because of heat from a fire the locking pin is released and driven by spring action into the hole in the latch bolt case to physically bar withdrawal of the latch bolt, and consequent opening of the door.

6 Claims, 5 Drawing Figures

Fig. 1.
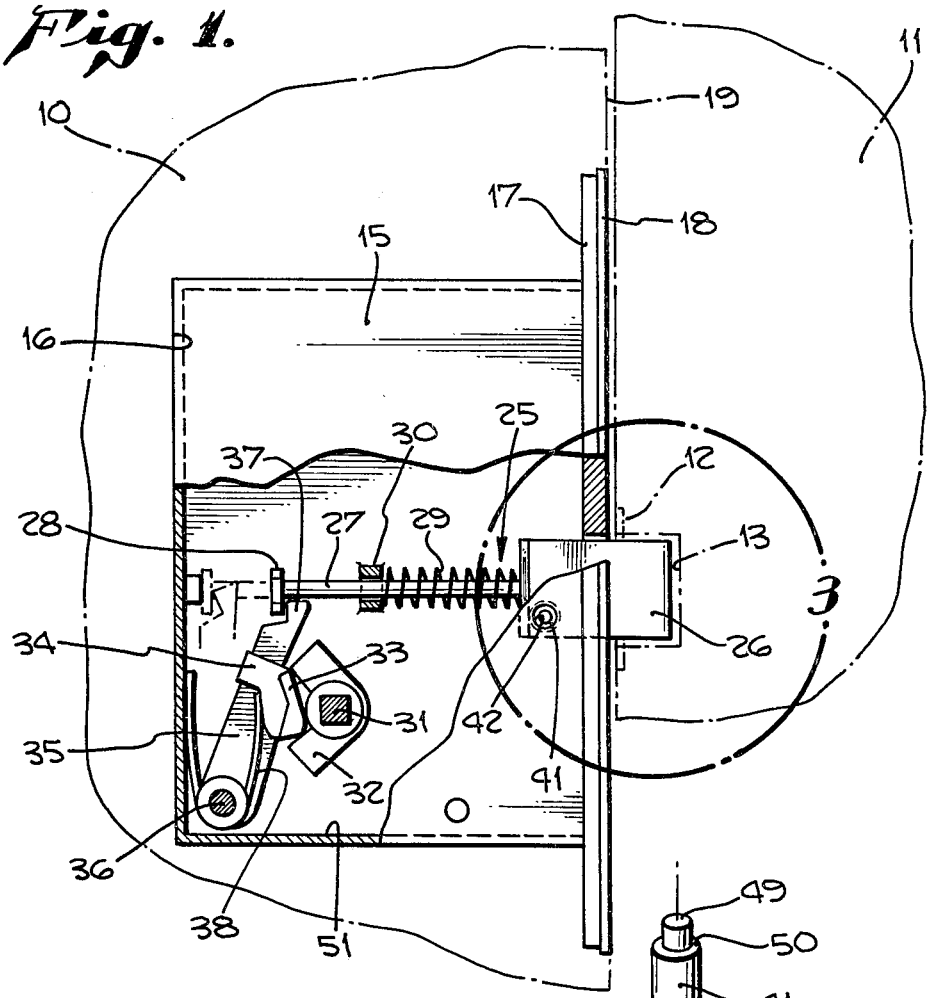
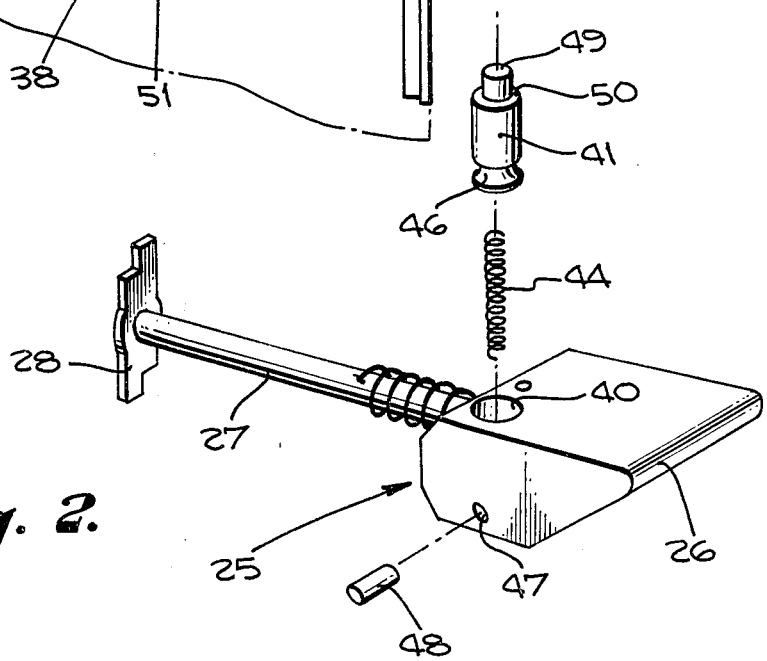
Fig. 2.

LATCH BOLT LOCKING MECHANISM FOR FIRE DOOR LOCKSETS

Fire doors as used on buildings are normally intended to be closed and to remain closed in case of fire, in order to minimize drafts which could spread a fire more rapidly through the building. Although fire doors are intended to be left closed it is not feasible to keep such doors when closed in a locked condition under normal circumstances. It is however, highly important that opening of the door when a fire condition prevails is at least discouraged, and preferably assured.

When the lockset chances to be one provided with a lever instead of a knob, for unlatching the latch bolt, there is always the prospect that a fire fighter's water stream, or falling debris, might strike the lever and unlatch the latchbolt causing the door to open, and thus creating an unfavorable draft situation. It is also possible that persons actually not needing to make use of the fire door might inadvertently open the fire door under such circumstances, thus to create a similar unfavorable draft condition.

Various methods have been advocated to prevent inadvertent lever lock actuation under fire conditions. Among these is disengagement of lever handles through clutching mechanisms or by use of a fusible material. While such methods may prevent lock function as a result of lever action, they do not provide positive locking of the latch bolt. A more simple and feasible method is employment of a fusible pin controlled mechanism which, at a predetermined temperature, locks the latchbolt in extended position. Several mechanisms have been devised to accomplish such latchbolt locking. The more familiar ones entail housing a mechanism of the sort made reference to internally in the lock case thereby creating possible interference problems with other components of the lock mechanism. This is particularly applicable when planned for use on all latchbolt functions of a given lock series.

It is among the objects of the invention therefore to provide a mechanism which will be a positive lock for the latchbolt under fire conditions for all latchbolt functions, without interfering with the functional or positional aspects of the lock mechanism components.

Another object of the invention is to provide a new and improved latchbolt locking mechanism for rendering the latchbolt of a fire door unoperable by maintaining it in locked position when subject to a fire condition.

Still another object of the invention is to provide a new and improved latchbolt locking means which is confined to the head of the latchbolt at a location remote from the mechanism whereby to remove prospect of interference with the mechanism.

Still another object of the invention is to provide a new and improved latchbolt locking mechanism associated with the latchbolt head which is simple in its construction positive in its operation and, in a sense fail-safe under fire conditions. With these and other objects in view, the invention consists of the construction, arrangement, and combination of the various parts of the device, serving as an example only of one or more embodiments of the invention, whereby the objects contemplated are attained, as hereinafter disclosed in the specification and drawings, and pointed out in the appended claims.

FIG. 1 is a side elevational view partially broken away showing operating portions of a substantially conventional mortise type lock in position on a door hung in an appropriate frame.

FIG. 2 is a perspective exploded view of the latch bolt unit.

Figure 3:
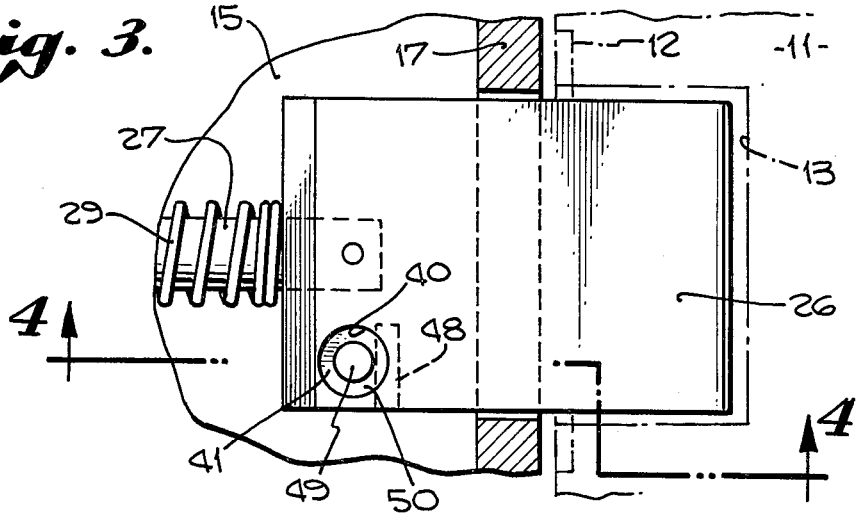
FIG. 3 is a longitudinal sectional view on the circular line three of FIG. 1.

In an embodiment of the invention chosen for the purpose of illustration there is shown a fragment of door 10 adapted to swing within a door frame 11, the door being provided with a strike plate 12 in which is located a latchbolt recess 13. By way of illustration there is shown a mortise type lock provided with a case 15 set in an appropriate mortised recess 16 in the door 10. The case is provided with a front plate 17 together with a face plate 18 countersunk in an edge face 19 of the door 10.

A latchbolt unit 25, shown in exploded view in FIG. 2, consists, in the embodiment shown, of a head 26 and latchbolt rod 27. At the inner end of the latchbolt rod is a foot 28. A coiled spring 29, acting at one end against the head 26 and at the other end against a spring keeper 30 in the case 15 serves to normally extend the latchbolt head outwardly to a position of retention within the latchbolt recess 13.

For withdrawing the latchbolt there is provided a spindle 31 retained in a hub 32 which, when rotated, acts against a cam way 33 of a follower 34, the follower in turn being carried on a retract lever 35. The retract lever pivots about a pivot pin 36 in the case 15 enabling a roll back 37 to be moved against the foot 28 in order to withdraw the latchbolt head 26. A return spring 38 serves to return the retract lever to the initial position of FIG. 1 and to hold the cam way 33 in snug position against the hub 32.

Figure 4:
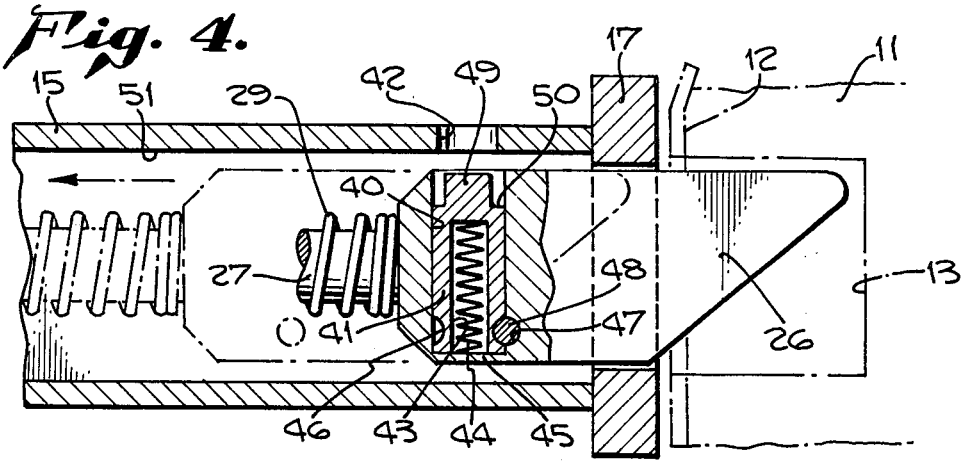
FIG. 4 is a fragmentary sectional view on the line 4—4 of FIG. 3 with the latchbolt unit in operating condition.

Located in the head 26 is a bore 40 within which is reciprocatably mounted a locking pin 41. In extended position of the head 26 the bore 40 and in consequence the locking pin 41 are in transverse alignment with a hole 42 in the case 15, the case 15 obviously being fixed in position in the door 10. Within the locking pin is a counter bore 43 which accommodates a coil spring 44. The spring 44 being bottomed against a wall section 45 of the head, and the bottom of the counter bore 43, is biased to normally urge the locking pin 41 in an outward direction. For retaining the locking pin in withdrawn or inoperative position, as shown in FIG. 4, there is provided an annular recess or groove 46 at the inner end of the locking pin. Extending in right annular relationship with respect to the bore 40 is a release pin bore 47, the release pin bore being in a position to intersect the space occupied by the annular recess 46, when the locking pin is the withdrawin position of FIG. 4. For holding the locking pin at that location a fusible release pin 48 is inserted into the release pin bore 47 to a position where one half of its circumference is received in the annular recess 46 at a corresponding side of the recess. With the locking pin secured in withdrawn position in the manner described, the latchbolt unit including the latchbolt head is free to be reciprocated in the latchbolt recess 13 between withdrawn position and extended position in a conventional fashion.

Figure 5:
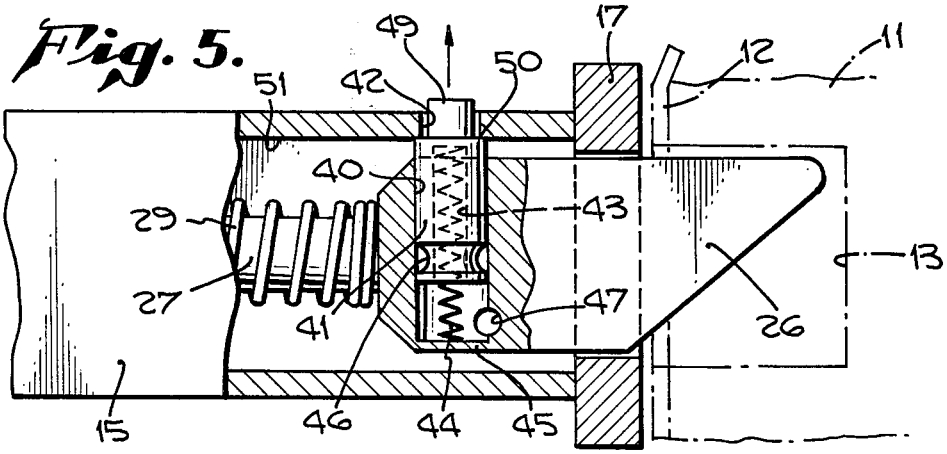
FIG. 5 is a fragmentary sectional view similar to FIG. 4 but with the latchbolt in locked extended position.

Should occasion arise, such as a fire, when it is desirable to have the door 10 remain closed with the latchbolt unit extended heat from the fire will ultimately reach a point where the material of the fusible release pin 48 melts. When that occurs the locking pin is released and will move under the expanding pressure of the spring 44 from the position of FIG. 4 to the position of FIG. 5. Since at that time the head 26 is in extended position the locking pin 41 will extend laterally outwardly until a projection 49 on the pin enters the hole 42 and a shoulder 50 adjacent the base of the projection 49 bottoms against the inside face 51 of the case 15 in the area surrounding the hole 42. Thus positioned the head 26 is prevented from movement out of its extended latched position, consequently an inadvertent attempt either by accident or design to rotate the spindle 31 is blocked by engagement of the extension 49 of the locking pin 51 in the hole 42 serving as a shoulder. As a consequence, the door 10 cannot be opened.

It should be noted that by reason of locating the locking pin at the head end of the latchbolt unit, the location is well out of the way of all portions of a chamber 51 within the case 15 and consequently, well out of the way of any and all mechanisms located within the chamber. As a result of this, as well as by reason of the simplicity of the structure and character of the parts embodied in the locking bolt and its environment, there is little or nothing to impair dependable action in holding the fire door closed whenever such need should arise.

I claim:

1. A locking mechanism for a latch bolt unit in a door for holding the latch bolt unit in engagement with the door when in extended position upon release of said mechanism and wherein there is a slideway in the door in which said latch bolt unit is reciprocatably mounted, a shoulder stationarily located on a portion of the door in communication with said slideway and latch bolt spring means acting between the latch bolt unit and the door biased in a direction to move said latch bolt unit to extended position, said mechanism including means forming a locking pin hole in said latch bolt unit which extends transversely of the latch bolt unit and in alignment with the shoulder when the latch bolt unit is in extended position, a locking pin reciprocatably mounted in said locking pin hole and locking pin spring means biased in a direction urging said locking pin laterally outwardly, a recess in said locking pin, means forming a release pin bore in said latch bolt unit in alignment with said recess in withdrawn position of the locking pin, and a release pin of fusible material in said release pin bore and extending into said recess acting to withhold said locking pin from engagement with said shoulder.

2. A locking mechanism as in claim 1 wherein the locking pin has a shoulder facing outwardly and adapted to engage said portion of door upon release of said locking pin whereby to limit outward movement.

3. A locking mechanism as in claim 1 wherein there is a counter bore in the locking pin at the inside end and said locking pin spring means is a coil spring located in said counter bore.

4. A locking mechanism as in claim 1 wherein said recess is an annular groove extending around the circumference of the locking pin.

5. A locking mechanism as in claim 1 wherein there is a case in which said slideway is located for reception of the latchbolt unit and said shoulder comprises a hole in the case.

6. A locking mechanism as in claim 5 wherein said latchbolt unit comprises a head and a rod on said head and said locking pin hole is located in said head.

* * * * *